US009986779B2

(12) United States Patent
Pritz et al.

(10) Patent No.: US 9,986,779 B2
(45) Date of Patent: Jun. 5, 2018

(54) LOCKING LINEAR FOR HELMET

(71) Applicant: Bell Sports, Inc., Scotts Valley, CA (US)

(72) Inventors: Ben D. Pritz, Santa Cruz, CA (US); Eamon Briggs, Santa Cruz, CA (US); Benjamin W. Penner, Santa Cruz, CA (US); Brian W. Eisman, Soquel, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 135 days.

(21) Appl. No.: 14/674,772

(22) Filed: Mar. 31, 2015

(65) Prior Publication Data

US 2015/0272257 A1 Oct. 1, 2015

Related U.S. Application Data

(60) Provisional application No. 61/973,396, filed on Apr. 1, 2014.

(51) Int. Cl.
*A42B 3/12* (2006.01)

(52) U.S. Cl.
CPC ..... *A42B 3/127* (2013.01)

(58) Field of Classification Search
CPC ..... A42B 3/085; A42B 3/10; A42B 3/125; A42B 3/127
See application file for complete search history.

(56) References Cited

U.S. PATENT DOCUMENTS

| | | | | | |
|---|---|---|---|---|---|
| 3,082,427 | A | | 3/1963 | Zbikowski | |
| 3,153,792 | A | * | 10/1964 | Marietta | A42B 3/127 2/414 |
| 3,720,955 | A | * | 3/1973 | Rawlings | A42B 3/127 2/415 |
| 3,994,022 | A | * | 11/1976 | Villari | A42B 3/121 2/413 |
| 4,354,284 | A | | 10/1982 | Gooding | |
| 5,718,004 | A | * | 2/1998 | Broersma | A42B 3/28 2/171.3 |

(Continued)

FOREIGN PATENT DOCUMENTS

| | | |
|---|---|---|
| RU | 2175514 | 11/2001 |
| WO | WO2005006900 | 1/2005 |

*Primary Examiner* — Richale Quinn
*Assistant Examiner* — Anne Kozak
(74) *Attorney, Agent, or Firm* — Booth Udall Fuller, PLC

(57) ABSTRACT

A helmet can comprise an outer shell comprising an outer surface and an inner surface opposite the outer surface, wherein the inner surface of the outer shell comprises an integrally formed locking mechanism. The helmet can also comprise a locking liner formed of a foam material and disposed within the outer shell adjacent the inner surface of the outer shell. The locking liner can further comprise at least one side piece sized to fit between a lower edge of the outer shell and top portion of the outer shell, a top piece disposed at the top portion of the outer shell and comprising a central opening, and a rotatable foam locking piece sized to fit within the central opening and comprising a tab that is sized to mateably couple with the integrally formed locking mechanism of the outer shell to releasably couple the locking liner to the outer shell.

18 Claims, 7 Drawing Sheets

(56) References Cited

U.S. PATENT DOCUMENTS 6,202,223 B1 * 3/2001 Chartrand ..... A42B 3/127 2/410
6,934,971 B2 * 8/2005 Ide ..... A42B 3/08 2/424
6,986,168 B2 * 1/2006 Abelman ..... A42B 3/00 2/412
8,296,868 B2 * 10/2012 Belanger ..... A42B 3/324 2/414
8,566,968 B2 * 10/2013 Marzec ..... A42B 3/064 2/411
9,320,311 B2 * 4/2016 Szalkowski ..... A42B 3/12
2003/0007845 A1 * 1/2003 Gens ..... F16B 25/00 411/411
2009/0158506 A1 * 6/2009 Thompson ..... A42B 3/127 2/411
2012/0036620 A1 * 2/2012 Harris ..... A42B 3/127 2/414
2013/0014313 A1 * 1/2013 Erb ..... A42B 3/122 2/410
2013/0061375 A1 * 3/2013 Bologna ..... A42B 3/122 2/414
2013/0086733 A1 * 4/2013 Szalkowski ..... A42B 3/12 2/414
2013/0125296 A1 * 5/2013 Rabinovitch ..... A42B 3/046 2/413
2013/0333100 A1 * 12/2013 Erb ..... A42B 3/124 2/425
2014/0096311 A1 * 4/2014 Halldin ..... A42B 3/064 2/411
2014/0109297 A1 * 4/2014 Lanez ..... A42B 3/04 2/411
2014/0223641 A1 * 8/2014 Henderson ..... A42B 3/127 2/411
2016/0316846 A1 * 11/2016 Salvetti ..... A42B 3/125
2016/0316847 A1 * 11/2016 Weber ..... A42B 3/064

* cited by examiner

LOCKING LINEAR FOR HELMET

RELATED APPLICATIONS

This application claims the benefit of U.S. provisional patent application 61/973,396, filed Apr. 1, 2014 titled "Locking Liner for Helmet," the entirety of the disclosure of which is incorporated by this reference.

TECHNICAL FIELD

This disclosure relates to a helmet comprising a locking liner and a method for making and using the same. The locking liner can be disposed within an outer shell of the helmet, and the locking liner can be lockably coupled to the outer shell for increased helmet performance and energy management.

BACKGROUND

Protective headgear and helmets have been used in a wide variety of applications and across a number of industries including sports, athletics, construction, mining, military defense, and others, to prevent damage to a user's head and brain. Damage and injury to a user can be prevented or reduced by helmets that prevent hard objects or sharp objects from directly contacting the user's head. Damage and injury to a user can also be prevented or reduced by helmets that absorb, distribute, or otherwise manage energy of an impact.

Different types of helmets have been used for different industries and for different applications, a number of which are included below. For example, U.S. Pat. No. 3,344,433 (hereinafter the "'433 patent") shows a helmet shell with a liner removably attached to the helmet shell using hook and loop fasteners. U.S. Pat. No. 3,192,536 (hereinafter the "'536 patent") shows a helmet shell with straps, webs, or suspended liners attached to the helmet shell with clips or rivets. Each of the '433 patent and the '536 patent are discussed briefly below with respect to FIGS. 1A and 1B.

FIG. 1A shows an approach to a helmet 10 that is similar to the helmet shown in FIG. 2 of the '433 patent. As shown in FIG. 1A, the helmet 10 can comprise a liner 12, into which are disposed a number of removable inserts or pads 14. Each pad 14 can be secured to the liner 12 by pairs of interlocking strips 16, such as strips of hook and loop fasteners. A foam backing or adhesive on the strips 16 can bond the each of the pair of the strips 16 to the liner 12. The pads 14 can be secured in position by pressing the pads 14 against the liner 12 to effect interlocking of the interlocking strips 16, and the pads can be removed from the liner 12 by pulling the pads 14 away from the liner 12 to release the interlocking strips 16 from holding the pads 14 to the liner 12.

FIG. 1B shows an approach to a helmet 20 that is very different to the approach discussed above with respect to the helmet 10 in FIG. 1A. FIG. 1B shows the helmet 20, which is similar to the helmet shown in FIG. 9 of the '536 patent. As shown in FIG. 1B, the helmet 20 can comprise a fiberglass, metal, or plastic shell 22 and a headband 24 that is coupled to the shell 22 by placing a portion 25 of the headband 24 into a slot structure 26 that can be molded into the shell 22. The headband 24 can further be coupled to straps 28 that pass over a head of a wearer of the helmet 20, the straps 28 forming a seat for the head of the wearer as well as maintaining a certain specified distance between the head of the wearer and a top inside surface of the shell 22.

SUMMARY

A need exists for an improved helmet. Accordingly, in an aspect, a helmet can comprise an outer shell comprising an outer surface and an inner surface opposite the outer surface, wherein the inner surface of the outer shell comprises an integrally formed locking mechanism. The helmet can comprise a locking liner formed of a foam material and disposed within the outer shell adjacent the inner surface of the outer shell. The locking liner can further comprise at least one side piece sized to fit between a lower edge of the outer shell and top portion of the outer shell. The locking liner can comprise a top piece disposed at the top portion of the outer shell and comprise a central opening. The locking liner can comprise a rotatable foam locking piece sized to fit within the central opening and comprising a tab that is sized to mateably couple with the integrally formed locking mechanism of the outer shell to releasably couple the locking liner to the outer shell.

The helmet can further comprise the locking liner being releasably coupled to the outer shell with a mechanical connection between the rotatable foam locking piece and the integrally formed locking mechanism of the outer shell without hook and loop fasteners and without an adhesive. The rotatable foam locking piece can comprise a circular footprint to allow the rotatable foam locking piece to rotatably engage with the integrally formed locking mechanism of the outer shell. The integrally formed locking mechanism can comprise a vertical portion that extends away from the inner surface of the outer shell to a distal end, and a horizontal portion that extends from the distal end of the vertical portion to form a gap sized to receive the tab of the rotatable foam locking piece. The foam of the locking liner and the rotatable foam locking piece can comprise expanded polypropylene (EPP), expanded polystyrene (EPS), expanded polyurethane (EPU), or expanded polyolefin (EPO). The at least one side piece can comprise a first lip along an upper edge of the at least one side piece, the top piece can comprise a second lip disposed at a lower edge of the top piece, the second lip sized to mateably couple with the first lip and further comprises a third lip disposed around the central opening, and the rotatable foam locking piece can comprise a fourth lip around an edge of the rotatable foam locking piece, the fourth lip sized to mateably couple with the third lip and releasably couple the top piece and the at least one side piece to the outer shell. The top piece can comprise a non-circular footprint. An optional adhesive or hook and loop fasteners can be disposed between a portion of the locking liner and the inner surface of the outer shell to releasably couple the locking liner to the outer shell together with the mechanical connection of the rotatable foam locking piece and the integrally formed locking mechanism of the outer shell.

In another aspect, a helmet can comprise an outer shell comprising an outer surface and an inner surface opposite the outer surface, wherein the inner surface of the outer shell comprises a locking mechanism. The helmet can comprise a locking liner formed of a foam material and disposed within the outer shell, the locking liner further comprise a top piece comprising an opening, and a foam locking piece sized to fit within the opening and comprising a tab that is sized to mateably couple with the locking mechanism of the outer shell to releasably couple the locking liner to the outer shell.

The helmet can further comprise the locking liner being releasably coupled to the outer shell with a mechanical connection of the foam locking piece and the locking mechanism of the outer shell without hook and loop fasteners and without an adhesive. The foam locking piece can comprise a circular footprint to allow the foam locking piece to rotatably engage with the locking mechanism of the outer shell. The locking mechanism can comprise a vertical portion that extends away from the inner surface of the outer shell to a distal end, and a horizontal portion that extends from the distal end of the vertical portion to form a gap sized to receive the tab of the rotatable foam locking piece. The foam of the locking liner and the foam locking piece can comprise EPP, EPS, EPU, or EPO. An optional adhesive or hook and loop fasteners can be disposed between a portion of the locking liner and the inner surface of the outer shell to releasably couple the locking liner to the outer shell together with a mechanical connection of the foam locking piece and the locking mechanism of the outer shell. A method of assembling the helmet can comprise disposing the at least one side piece within the outer shell, and disposing the rotatable foam locking piece within the outer shell and rotating the rotatable foam locking piece such that the rotatable foam locking piece is releasably coupled to the integrally formed locking mechanism of the outer shell.

In another aspect, a helmet can comprise an outer shell comprising an outer surface and an inner surface opposite the outer surface, wherein the inner surface of the outer shell comprises a locking mechanism. A locking liner formed of a foam material can be disposed within the outer shell, the locking liner comprising a foam locking piece comprising a tab that is sized to mateably couple with the locking mechanism of the outer shell to releasably couple the locking liner to the outer shell.

The helmet can further comprise the foam locking piece comprising a circular footprint to allow the foam locking piece to rotatably engage with the integrally formed locking mechanism of the outer shell. The integrally formed locking mechanism can comprise a vertical portion that extends away from the inner surface of the outer shell to a distal end, and a horizontal portion can extend from the distal end of the vertical portion to form a gap sized to receive a tab of the foam locking piece. The locking liner can comprise EPP, EPS, EPU, or EPO. An optional adhesive or hook and loop fasteners can be disposed between a portion of the locking liner and the inner surface of the outer shell to releasably couple the locking liner to the outer shell together with the mechanical connection of the foam locking piece and the integrally formed locking mechanism of the outer shell.

DETAILED DESCRIPTION

Figure 1A:
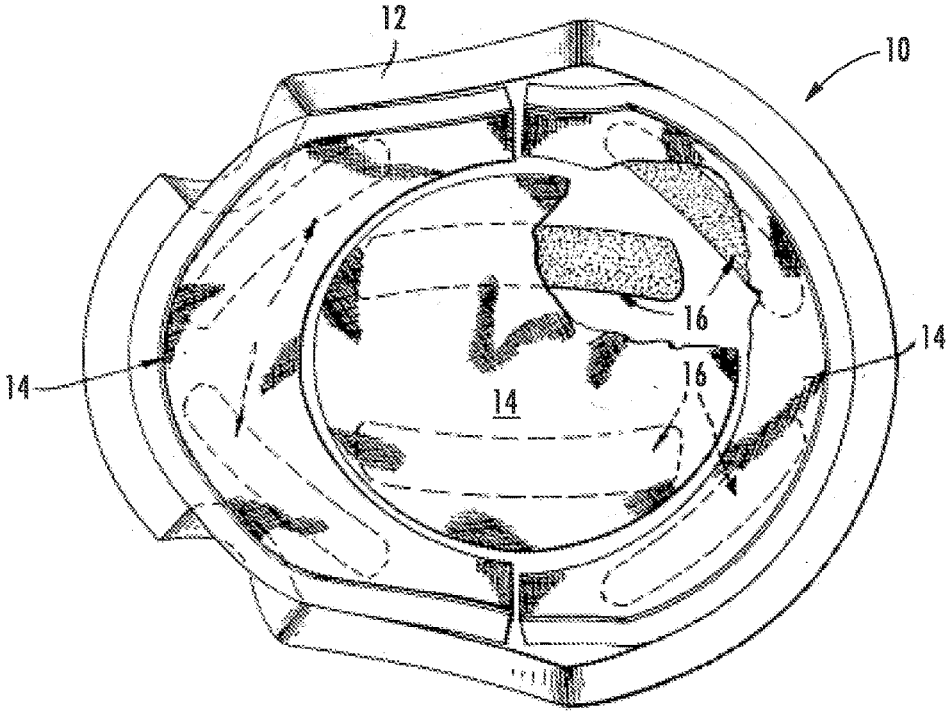
FIG. 1A PRIOR ART
FIGS. 1A and 1B show embodiments of protective helmets as known in the prior art.
Figure 1B:
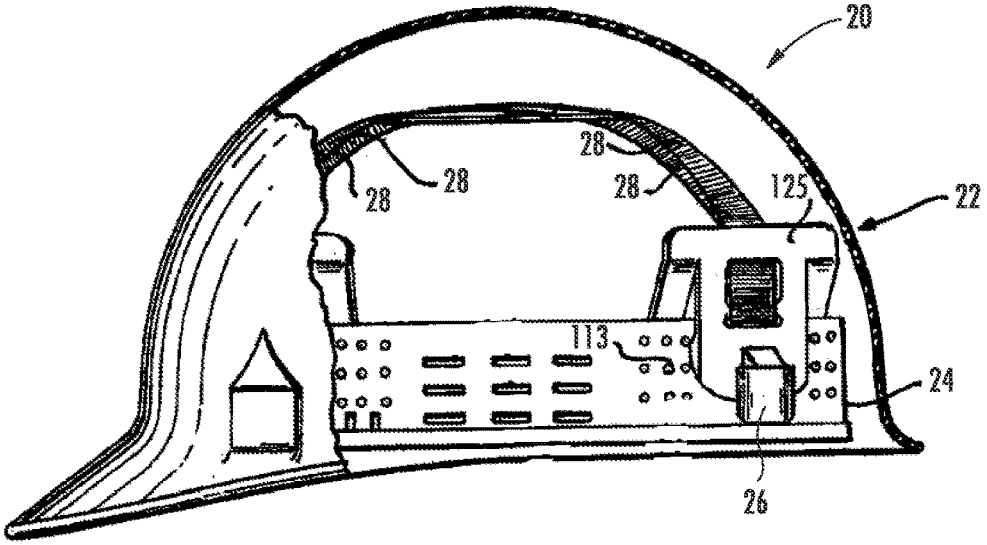
FIG. 1B PRIOR ART

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail, particular embodiments with the understanding that the present disclosure is to be considered as an exemplification of the principles of the disclosed methods and systems, and is not intended to limit the broad aspect of the disclosed concepts to the embodiments illustrated.

This disclosure provides a device, apparatus, system, and method for providing a helmet or protective head gear that includes an outer shell and an inner energy absorbing layer, such as foam, that can be used for a cyclist, football player, hockey player, baseball player, lacrosse player, polo player, climber, auto racer, motorcycle rider, motocross racer, skier, snowboarder or other snow or water athlete, sky diver or any other athlete in a sport. Other industries also use protective headwear, such that individuals employed in other industries and work such as construction workers, soldiers, fire fighters, pilots, or types of work and activities can also use or be in need of a safety helmet, where similar technologies and methods can also be applied. Each of the above listed sports, occupations, or activities can use a helmet that includes either single or multi-impact rated protective material base that is typically, though not always, covered on the outside by a decorative cover and includes comfort material on at least portions of the inside, usually in the form of comfort padding.

Generally, protective helmets, such as the protective helmets listed above, can comprise an outer shell and in inner energy-absorbing material. For convenience, protective helmets can be generally classified as either in-molded helmets or hard shell helmets. In-molded helmets can comprise one layer, or more than one layer, including a thin outer shell, an energy-absorbing layer or impact liner, and a comfort liner or fit liner. Hard-shell helmets can comprise a hard outer shell, an impact liner, and a comfort liner. The hard outer shell can be formed by injection molding and can include Acrylonitrile-Butadiene-Styrene (ABS) plastics or other similar or suitable material. The outer shell for hard-shell helmets is typically made hard enough to resist impacts and punctures, and to meet the related safety testing standards, while being flexible enough to deform slightly during impacts to absorb energy through deformation, thereby contributing to energy management. Hard-shell helmets can be used as skate bucket helmets, motorcycle helmets, snow and water sports helmets, football helmets, batting helmets, catcher's helmets, hockey helmets, and can be used for BMX riding and racing. While various aspects and implementations presented in the disclosure focus on embodiments comprising hard-shell helmets or helmets comprising an outer shell, the disclosure also relates and applies to other helmets, applications, and embodiments in which the principles and features discussed herein can be advantageously applied. As such, the locking liner helmet disclosed herein can be employed wherever a conventional helmet is used to take advantage of the additional benefits described herein.

Figure 2A:
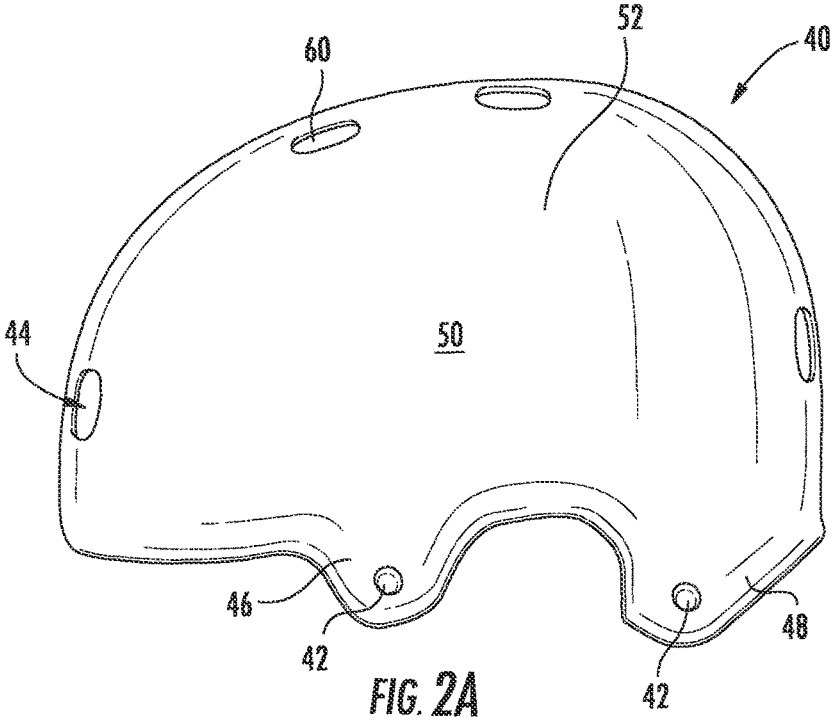
FIGS. 2A and 2B show outer and inner portions, respectively, of a helmet comprising a locking liner.
Figure 2B:
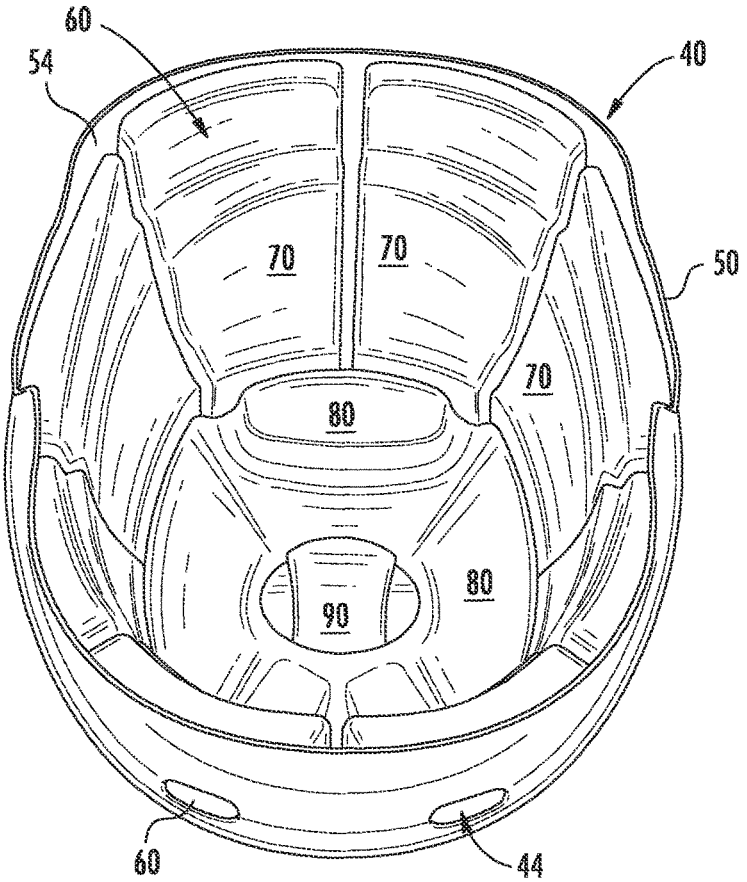

FIGS. 2A and 2B show outer and inner portions, respectively, of a helmet 40 comprising an outer shell 50 and a locking liner 60. More specifically, FIG. 2A shows a profile view of the helmet 40 that includes an outer surface 52 of the outer shell 50. The outer shell 50 can be made of a flexible, semi-flexible, or rigid material, and can comprise plastics, including polycarbonate (PC), polyethylene terephthalate (PET), acrylonitrile butadiene styrene (ABS), polyethylene (PE), polyvinyl chloride (PVC), vinyl nitrile (VN), as well as resin, fiber, fiberglass, carbon fiber, Kevlar, or other suitable material. The outer shell 50 can be stamped, in-molded, injection molded, vacuum formed, or formed by another suitable process. The outer shell 50 can also provide a smooth aerodynamic finish, a decorative finish, or both, for improved performance, improved aesthetics, or both. As a non-limiting example, the outer shell 50 can be ABS that is formed by injection molding.

The outer shell 50 can also includes a number of rivets, screws, or other fastening devices 42 that can be made of metal, plastic, or other suitable material that can be attached to the outer shell 50 for securing straps to the helmet 40, for securely and releasably coupling the helmet 40 to a head of a user wearing the helmet 40. As shown in FIG. 2A, the rivets 42 can be placed in various portions of the outer shell 50 including in a temple tab 46 and a collar tab 48. As shown in FIG. 2A, the temple tab 46 and a collar tab 48 can be portions of the outer shell 50 located at an outer edge of the outer shell adjacent a recess or opening for a user's ear.

FIG. 2A also shows a plurality of vents 44 that can be formed as openings or voids through the helmet 40, including through the outer shell 50, to provide increased ventilation and airflow through the helmet. As indicated in FIG. 2A, a portion of the locking liner 60, which is discussed in greater detail below, can be seen through the vents 40.

FIG. 2B shows a perspective view of an underside of the helmet 40 showing a portion of the outer shell 50 and additional detail of the locking liner 60 that was blocked by the outer shell 50 in FIG. 2A. FIG. 2B shows the helmet 40 inverted from its upright position to better illustrate the locking liner 60 and an interior space within the helmet 40 into which the head of a user would be disposed. While the outer shell 50 is, for convenience, referred to throughout this disclosure as an "outer" shell, the term outer is used to describe a relative position of the outer shell 50 with respect to the locking liner 60 and the user's head when the helmet 40 is worn by the user. Additional layers, liners, covers, or shells can be formed outside of the outer shell 50 because the outer shell 50 can be, but does not need to be, the outermost layer of the helmet 40. Similarly, the locking liner 60 can, for convenience, be referred to as being disposed at a position that is "inner" or within the outer shell 50 and is positioned more closely to the user's head. However, additional layers, liners, covers, or padding can be additionally disposed inside of the locking liner 60, as shown and described subsequently in relation to FIG. 3J, because the locking liner 60 can be, but does not need to be, the innermost layer of the helmet.

As shown in FIG. 2B, the locking liner 60 can be disposed inside, and adjacent, the outer shell 50. The locking liner 60 can be formed of one or more layers of an energy-absorbing material made of plastic, polymer, foam, or other suitable energy-absorbing material or impact liner to absorb, deflect, or otherwise manage energy and to contribute to energy management for protecting a wearer during impacts. The locking liner 60 can comprise, without limitation, EPP, EPS, EPU, EPO) vinyl nitrile (VN), or other suitable material that can manage absorb, or deflect energy from an impact by bending, flexing, crushing, or cracking. The locking liner 60 can be formed with any desirable shape including an outer surface that contacts and follows a contour of the inner surface 54 of the outer shell 50 and an inner surface that contacts and follows a contour of a head of the user.

FIG. 2B also shows that the locking liner 60 can be formed of multiple portions or a plurality of portions. The locking liner 60 can comprise a plurality, or one or more side pieces 70, a top piece or crown piece 80, and a locking piece 90, each or which are discussed in greater detail below with respect to FIGS. 3A-3J. The locking liner 60, including the side pieces 70, the top piece 80, and the locking piece 90, can be disposed adjacent, in direct contact with, or offset from, the inner surface 54 of the outer shell 50, wherein the inner surface 54 is opposite the outer surface 52 of the outer shell 50.

FIGS. 3A-3J, provide a graphical representation of how the locking liner 60 can be releasably coupled to the outer shell 50 by mechanically coupling the locking piece 90 of the locking liner 60 to the locking mechanism 56 formed or disposed on the inner surface 54 of the outer shell 50.

Figure 3A:
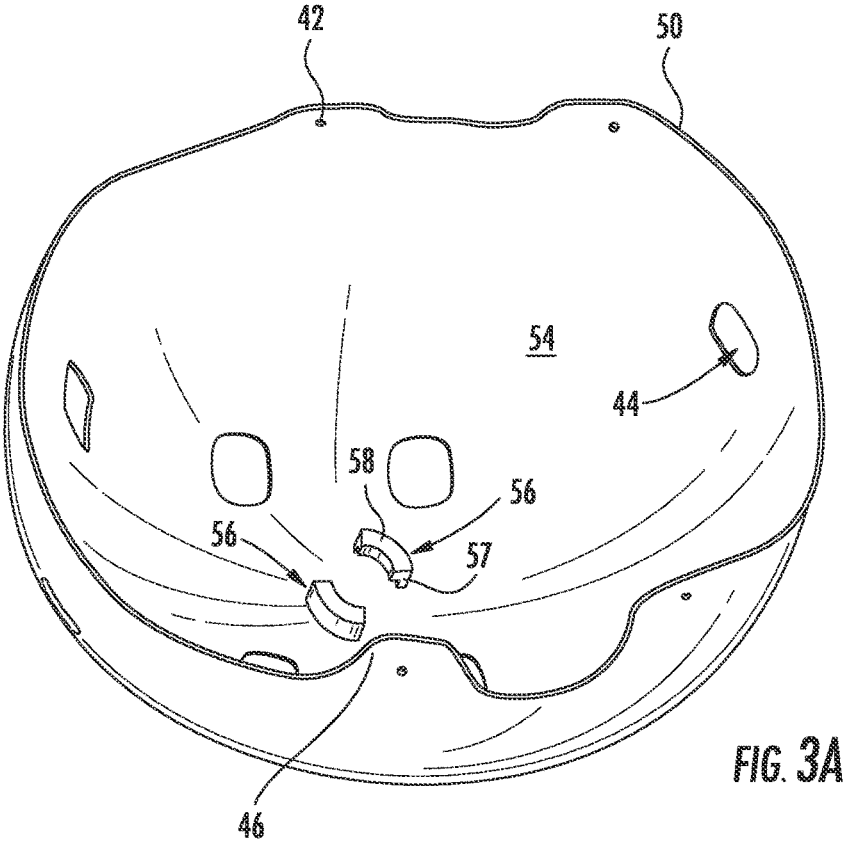
FIGS. 3A-3J show various views of portions of a locking liner being disposed within an outer shell of a protective helmet.

FIG. 3A shows a perspective view of the outer shell of the exemplary helmet shown previously in FIG. 2B, but differs from FIG. 2B in that the locking liner 60 has not yet been inserted within the outer shell 50 in the view presented in FIG. 3A. As such, FIG. 3A presents additional detail with respect to the inner surface 54 of the outer shell 50, including locking mechanism 56. The locking mechanism 56 can comprise one or more of a flange, clip, hook, channel, race, prong, clip, latch, detent, tab, or other suitable structure formed on, at, or near, the inner surface 54 of the outer shell 50, that is sized or configured to be releasably coupled to at least one portion of the locking liner 60, such as locking piece 90. In an embodiment, as shown in FIG. 3A, the locking mechanism 56 can be formed of multiple pieces or segments that can be space apart or offset from with respect to each other.

FIG. 3A shows an embodiment in which the locking mechanism 56 can be formed of two pieces, although the locking mechanism can also be formed of a single or unitary piece, three pieces, four pieces, or any number of pieces. Each of the one or more pieces of the locking mechanism 56 can comprise any suitable shape, size, form, or design, for being releasably coupled to the locking liner 60. FIG. 3A depicts an embodiment in which the pieces of the locking mechanism 56 can be integrally formed with the outer shell 50, and extend from the inner surface 54 of the outer shell 50. As a non-limiting example, the locking mechanism 56 can be formed by injection molding ABS into a same mold, and at a same time, as ABS is injection molded to form the outer shell 50. Alternatively, the locking mechanism 56 can be formed at a different time than the outer shell 50, such that the locking mechanism 56 is not integrally formed with the outer shell 50, but is separately formed and separately added or coupled to the outer shell 50.

Each piece of the locking mechanism 56 can be formed of one of more portions. FIG. 3A shows a non-limiting example in which first and second pieces of the locking mechanism 56, each labeled as 56, can comprise a vertical portion 57 that extends away from the inner surface 54 of the outer shell 50 to a distal end and a horizontal portion 58 that extends from the distal end of the vertical portion 57 to form a void or gap 59 between the horizontal portion 58 and the inner surface 54, which can be sized and configured to receive a tab, lip, or portion of the locking piece 90, which can be configured as a rotatable foam locking piece as discussed below in relation to FIGS. 3F-3I.

FIG. 3A also shows an embodiment in which the first and second portions of the locking mechanism 56 are formed in a circular shape, or with a circular footprint, whether a complete circle, a partial circle, or a three-dimensionally distributed circle formed as a spiral or threading, that can facilitate releasable coupling between the locking mechanism 56 and the locking liner 60, such as with locking piece 90, by turning or relative rotational movement between the locking mechanism 56 and the locking piece 90. In some embodiments, a single locking mechanism 56 comprising one or more pieces can be centrally located within the helmet 40, and centrally located on the inner surface 54 of the outer shell 50, such as at a top or crown portion of the helmet 40, although the locking mechanism can be positioned at any suitable position at an interface between the outer shell 50 and the locking liner 60. In other embodiments, multiple locking mechanisms 56 comprising one or more pieces can be disposed at multiple positions along or throughout the inner surface 54 of the outer shell 50.

By using the one or more locking mechanisms 56, the locking liner 60 can be releasably coupled to the outer shell 50 without the use of an adhesive, or as part of a glueless assembly as discussed in greater detail below. Alternatively, some glue or other adhesive can be used in addition to the locking mechanism 56 and the locking liner 60. In yet other embodiments, the locking liner 60 may be coupled to a locking mechanism 56 that can be formed as part of, or interface with, vents 44, with other holes or openings in the outer shell 50, or with another energy management layer or liner.

Figure 3B:
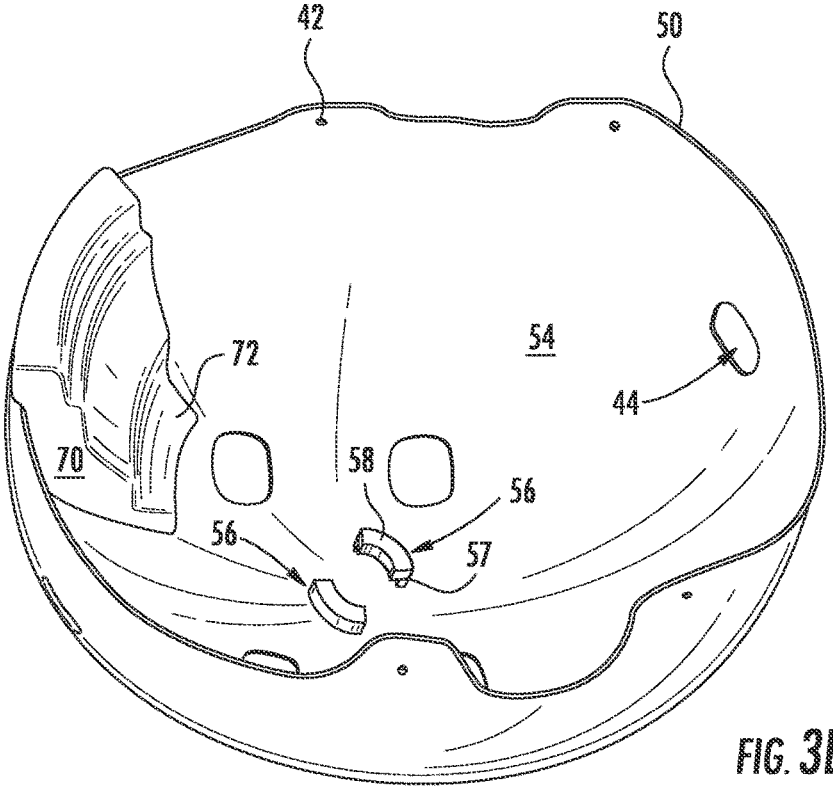

FIG. 3B shows a perspective view of the outer shell similar to the view presented in FIG. 3A. FIG. 3B differs from FIG. 3A by inclusion of a portion of the locking liner 60 disposed within the outer shell 50. More specifically, the locking liner 60 can comprise at least one locking portion and at least one non-locking portion.

The locking portion of the locking liner 60 can be a portion of the locking liner 60 that is in direct contact with the locking mechanism 56. For convenience of description, and not by way of limitation, the locking piece 90 can comprise the locking portion of locking liner 60, which is discussed in greater detail with respect to FIGS. 3E-3I.

A non-locking portion of the locking liner 60 can comprise a portion of the locking liner 60 that is not in direct contact with the locking mechanism 56. For convenience of description, and not by way of limitation, the side piece 70 and the top piece 80 can comprise the non-locking portion of locking liner 60. In some embodiments the non-locking portion can be formed as a single, unitary, or integrally formed piece of foam material or energy absorbing material, which can also include slots, channels, or openings to provide for some movement and flex in the non-locking portion. Alternatively, as shown in FIGS. 3B-3J, the non-locking portion of locking liner 60 can comprise one or more different types of pieces, such as the side pieces 70 and the top piece 80. Each type of piece can also include more than one piece, such as a plurality of side pieces 70. The non-locking portion of locking liner 60, including the side piece 70 and the top piece 80 can be separate and discrete, coupled together by friction, and possibly an optional adhesive, after having been disposed within the outer shell 50. Alternatively, the non-locking portion of locking liner 60, including the side piece 70 and the top piece 80 can be discrete pieces that are coupled or joined together by connectors, straps, cord, webbing, wire, a web, a frame, a flexible roll cage, or other suitable device that can be made of plastic, metal, textile, fiber, or other suitable material, and that can be in-molded during formation of the non-locking portion of the locking liner 60 or added after molding or formation of the non-locking portion of the locking liner 60.

FIG. 3B shows a single side piece 70 disposed within the outer shell 50, adjacent the interior surface 54, and extending to a lower edge of the outer shell 50. An edge of the side piece 70 opposite the lower edge of the outer shell 50 can be formed comprising a lip 72. The lip 72 can also be formed as a bevel, race, channel, ledge, mortise, tenon, or other suitable structure that is configured or sized to interface with the top piece 80 or the locking portion of the locking liner 60, such as locking piece 90. The lip 72 can that comprises a thickness less than a thickness of the main body of the side piece 70. The lip 72 can allow the side piece 70 to be indirectly held in place within the helmet 40, such as by top piece 80 and locking piece 90, and to be indirectly coupled to the locking mechanism 56 as shown and described with respect to subsequent figures.

Figure 3C:
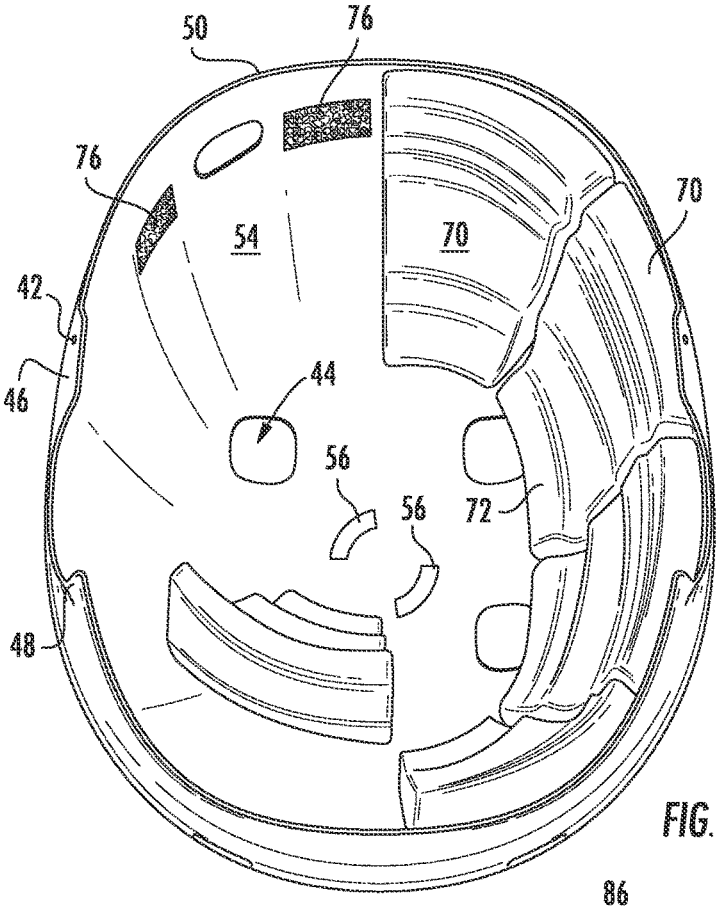

FIG. 3C shows a perspective view of the outer shell 50, similar to the view presented in FIG. 3B, but further comprising additional side pieces 70 of the locking liner 60 disposed within the outer shell 50. FIG. 3C illustrates a moment during the process of placing individual side pieces 70 within the outer shell 54. When disposed within the outer shell 50, the individual side pieces 70 can comprise spaces or gaps between each other, or alternatively, can be situated so as to contact or touch each other. In either event, the non-locking portion of the locking liner 60 or the side pieces 70 can provide for energy management along a side or skirt portion of the inner surface 54 of the outer shell 50 that is disposed below the top or crown portion of the outer shell and encircles an interior perimeter of the outer shell 50. The side pieces 70 can be disposed around an entire perimeter of the outer shell 54, or around a portion of the inner perimeter that is less than an entirety of the perimeter.

All or part of the locking liner 60, such as the side pieces 70, the top piece 80, the locking piece 90, or portions thereof, can be molded in a flat molding process. By forming one or more portions of the locking liner in a flat molding process, a number of advantages can be realized. First, flat molding can provide advantages from a manufacturing standpoint because using a flat mold does not require the additional complexity of moving parts with the mold. Similarly, flat molding does not require a curved mold for forming the entire locking liner 60, or a large portion thereof, to be formed at once or at a same time. Use of multiple pieces of the locking liner 60 can also permit greater flexibility in helmet shapes which are less dependent on being suitably shaped for being pulled form a mold.

Next, flat molding, the use of multiple pieces for the locking liner 60, or both, can also allow for the locking liner 60 to include foam or energy management materials of multiple densities or to be multi-density. For example, a segment of the locking liner 60 can comprise a first or outer layer, lamina, or strata of a first density that will be positioned closest to the outer shell 50, and a second or inner layer, lamina, or strata of a second density that will be positioned closer to the user's head and farther from the outer shell 54 than the first layer. The first layer can have a density that is greater than or less than a density of the second layer. Alternatively, different individual pieces or segments of the locking liner 60 can comprise a single density that is different from other individual pieces to form an alternative embodiment of a multi-density liner.

Attachment of all or part of the locking liner 60 to the outer shell 50 can be done in such a way that the locking liner 60 is removable from, and is disposed within, the outer shell 50, as part of a glueless assembly. As used herein, a glueless assembly can mean that all or an entirety of the locking liner 60, or that a portion less than all of the locking liner 60, can be attached to the outer shell 50 without glue, chemical attachment or bonding, an adhesive, permanent adhesive, pressure sensitive adhesive (PSA), foam-core adhesive, tape, two-sided tape, mounting foam adhesive, or other similar attachment, which for convenience are hereinafter collectively referred to as an adhesive 76. The adhesive 76, if optionally used, can be disposed at any location along the inner surface 54 of the outer shell 50, including along or near a lower edge of the outer shell 50, as shown in FIG. 3C.

In some embodiments, an adhesive can be used to indirectly couple the locking liner 60 to the outer shell 50, such as by using an adhesive to attach hook and loop fasteners, a clip, cleat, cutout, tab, snap, rivet, hog ring, or other suitable mechanical fasteners to the outer shell 50 and to the locking liner 60, such that the locking liner 60 can be releasably coupled to the outer shell 50 and be easily removed from the outer shell 50 because adhesive is not directly attached to locking liner 60 or the outer shell 50. However, in some embodiments, the locking liner 60 can also be coupled to the outer shell 50 without hook and loop fasteners or other similar chemical or mechanical attachment, and instead rely exclusively on the connection or interface between the locking piece 90 of the locking liner 60 and the locking mechanism 56 of the outer shell 50. In some instance, the helmet 40 can retain the locking liner 60 coupled to the outer shell 50 by relying on both the connection or interface between the locking piece 90 of the locking liner 60 and the locking mechanism 56 of the outer shell 50, as well as a curved or retaining geometry of the lower edge of the outer shell 50, such an inward curve of the temple tab or the collar tab 48, or other similar curve or retaining structure of the outer shell 50.

Figure 3D:
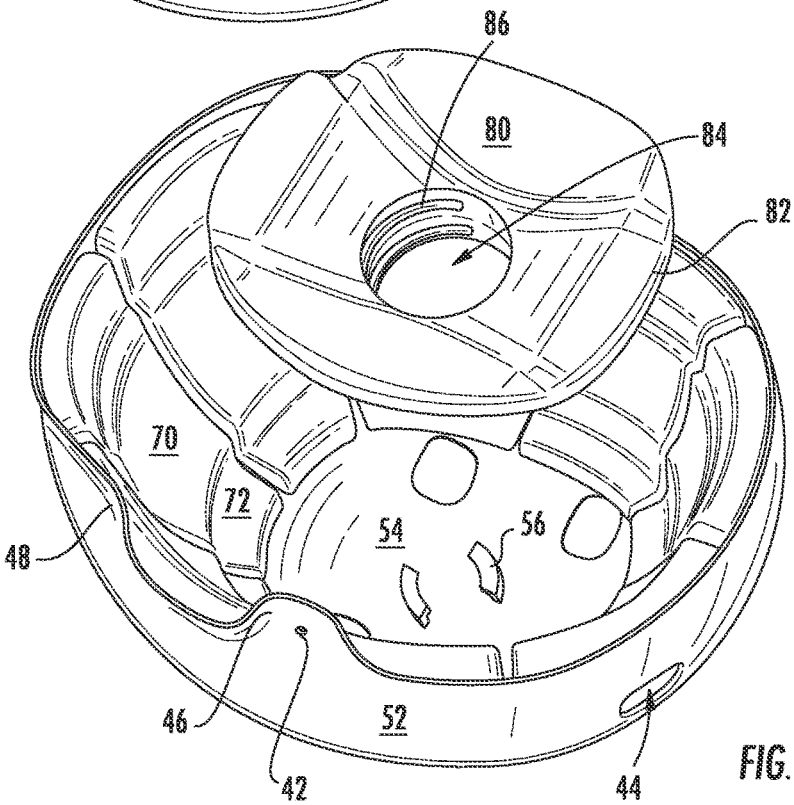

FIG. 3D shows a perspective view of the outer shell 50 at a point in which the entire inner perimeter of the inner surface 54 of the outer shell 50 is covered by or coupled with the side pieces 70 of the locking liner 60. FIG. 3D also shows an embodiment in which the locking liner 60 comprises a top piece 80, which is shown disposed over the outer shell 50 and the side pieces 70 before the top piece 80 is placed within the outer shell 50 and in contact with the side pieces 70.

The top piece 80 can also comprise a lip 82 formed or disposed at or on the lower edge of the top piece 80. The lip 82 can also be formed as a bevel, race, channel, ledge, mortise, tenon, or other suitable structure that is configured or sized to interface with the side pieces 70, and more specifically the lip 72 on the top edge of the side pieces 70. The lip 82 can comprise a thickness less than a thickness of the main body of the top piece 80. The lip 82 can allow the side piece 70 to be indirectly held in place within the helmet 40, such as by top piece 80 and locking piece 90, and to be indirectly coupled to the locking mechanism 56 through the top piece 80. In some embodiments, the lip 82 and the lips 72 can be formed as corresponding, mating, or mirror image structures that can contact each other when the top piece 80 of the locking liner 60 is inserted within the outer shell 50 to hold the side pieces 70 of the locking liner 60 in place.

The top piece 80 of the locking liner 60 can further comprise an opening or void 84 that can be located in the top piece 80 and configured to receive the locking piece 90 of the locking liner 60, which is discussed in greater detail below with respect to FIGS. 3E-3I. The opening 84 can be centrally located within the top piece 80 to align with a centrally located locking mechanism 56, although the opening 84 need not be centrally located within the top piece 80 or the locking liner 60, and can be located at any suitable position within the helmet 40. In some instances, the opening 80 can comprise multiple openings and be aligned with multiple locking mechanisms 56.

The opening 84 can further comprise a lip 86 formed or disposed adjacent or within the opening 84. The lip 86 can be formed as a bevel, race, channel, ledge, mortise, tenon, or other suitable structure that is configured or sized to interface with the locking piece 90. The lip 86 can comprise a thickness less than a thickness of the main body of the top piece 80. The lip 86 can allow the top piece 80 to be held in place within the helmet 40 by locking piece 90, and to be indirectly coupled to the locking mechanism 56 through the locking piece 90. In some embodiments, the lip 86 and a lip 92 of the locking piece 90 can be formed as corresponding, mating, or mirror image structures that can contact each other when the locking piece 90 is inserted within the opening 84 a releasably coupled to the locking mechanism 56 to hold the locking liner 60 in place within the helmet 40.

While FIG. 3D shows that the top piece 80 of locking liner 60 can be separate and distinct from the side pieces 70, in some embodiments the top piece 80 can also be integrally formed with the side piece 70 or coupled to the side piece 70 by a roll cage, straps, or other suitable connecting device to hold the top and side pieces together as a single unit. Thus, in some embodiments, the top piece 80 can extend from the top of the outer shell 50 and extend down to the lower edge of the outer shell 50. In either case, at least a portion of the top piece 80 can be disposed at a top part of the helmet 40 and be positioned such that the top piece 80 can contact a top or crown of a user's head when the helmet 40 is worn by the user.

By forming the locking liner 60 of a plurality of different pieces, such as one or more of side pieces 70, top piece 80, and locking piece 90, the locking liner 60 can provide increased design flexibility with respect to conventional one-body or monolithic protective helmets. Increased design flexibility can be achieved by forming the locking liner 60 comprising shapes, geometric forms, and orientations that would be difficult to accomplish with a single body liner. Constraints restricting shapes, geometric forms, and orientations of a single body liner include constraints for injecting foam or energy-absorbing material into a mold, constraints of removing the molded foam or energy-absorbing material from the mold, and constraints of machining or removing the single body liner from a template or standard blank of material such as a block of energy-absorbing material. For example, use of multiple interlocking body pieces for the locking liner 60 can allow for helmet shapes, geometric forms, and orientations that would be difficult or impossible to remove or pull from a 1-piece mold. As a non-limiting example, increased design flexibility with respect to helmet shape for the helmet 40 can include a helmet comprising a curvature or profile that follows a contour of the occipital region or occipital curve of user's head. Furthermore, increased design flexibility can be achieved because forming the locking liner 60, can simplify assembly of energy-absorbing material, such as at an EPS press.

Figure 3F:
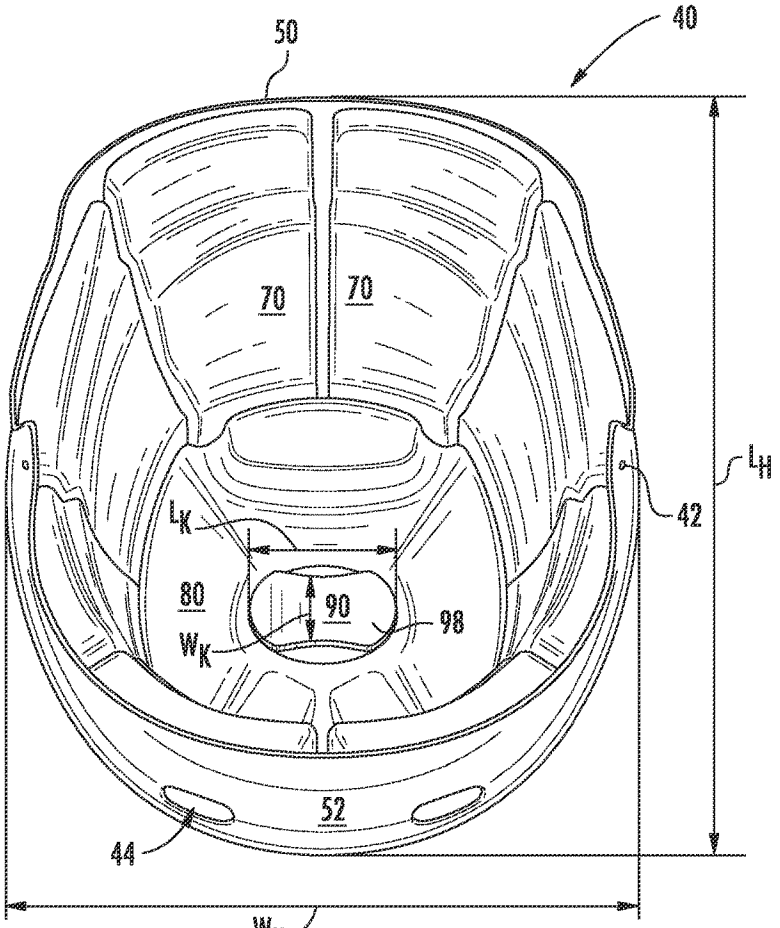
Figure 3E:
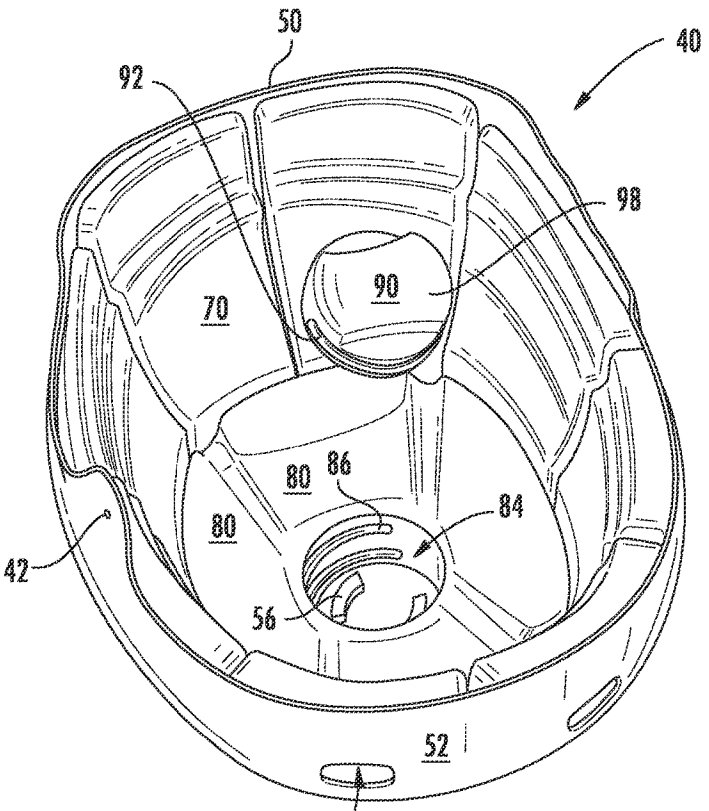

FIG. 3E shows a perspective view, similar to the perspective view shown in FIG. 3D, that shows the outer shell 50 and portions of the locking liner 60 after the top piece 80 has been placed together, and in contact with, the side pieces 70 of the locking liner 60 within the outer shell 50. FIG. 3E further shows the locking piece 90 90 of the locking liner 60 disposed above the opening 84 in locking liner 60, before the locking piece 90 is disposed within the opening 84 to be releasably coupled to the locking mechanism 56 of the outer shell 50. As shown in FIG. 3E, the locking piece 90 can further comprise a knob or twist tab 98 or other suitable structure, such as a flange, channel, race, prong, latch, detent, tab, ridge, or divot that allows a user to move or adjust a position of the locking piece 90 after the locking piece has been disposed within the opening 84 to engage with, and be releasably locked to, the locking mechanism 56. The user can move or adjust the position of the locking piece 90 by applying force to the knob 98 by to move the locking piece rotationally, translationally, or in any other suitable way to engage with the locking mechanism 56.

FIG. 3F shows a perspective view, similar to the perspective view of FIG. 3E. FIG. 3F differs from FIG. 3E in that FIG. 3F shows the outer shell 50 after the locking piece 90 90 of the locking liner 60 has been placed within the opening 84 in the top piece 80 of the locking liner 60. The locking piece 90 can be positioned so as to be disposed over, and in contact with, the locking mechanism 56 of the outer shell 50. Furthermore, FIG. 3F shows that the knob 98 of the locking piece 90 can comprise a length Lk that can be greater than, and perpendicular to, a width Wk of the knob 98. Similarly, the helmet 40 can also comprise a length Lh that can be greater than, and perpendicular to, a width Wh of the helmet 40. FIG. 3F shows a non-limiting example in which the length Lk of the knob 98 can be perpendicular or rotated about 90 degrees with respect to a length Lh of the helmet 40 when the locking piece 90 is first inserted within the opening 84, and has not been moved to be locked into position with the locking mechanism 56. However, any convenient relative position between the knob 98 and the helmet 40 can be used or designated for when the locking piece 90 has been dropped directly into place within the opening 84 and has not been moved or rotated to engage with the locking mechanism 56.

Figure 3H:
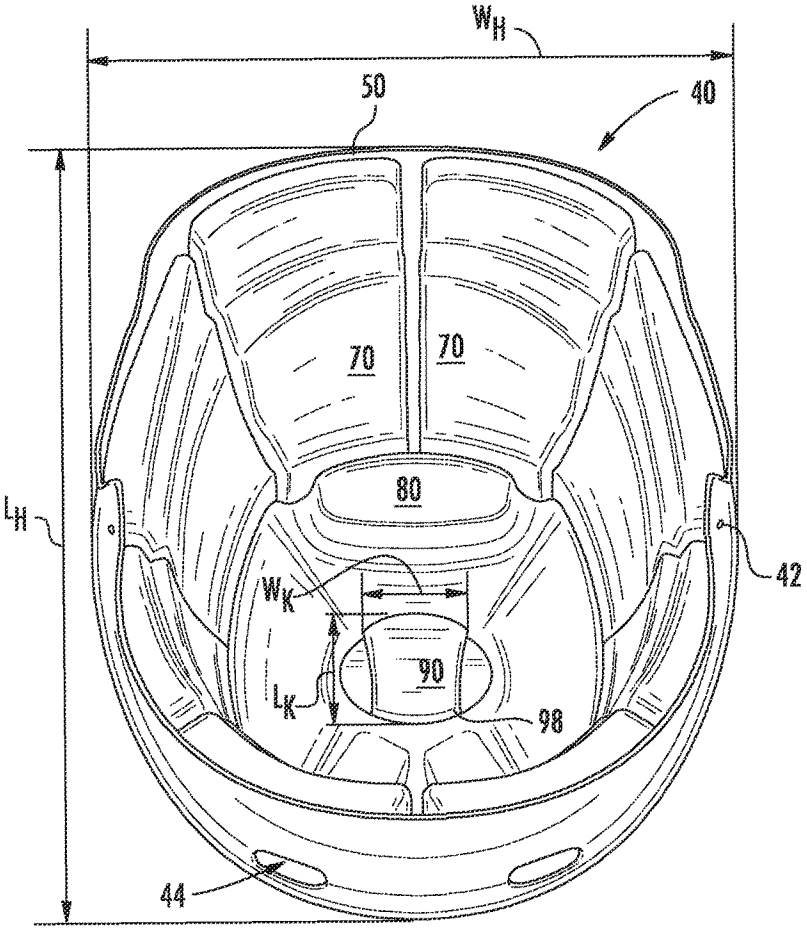
Figure 3G:
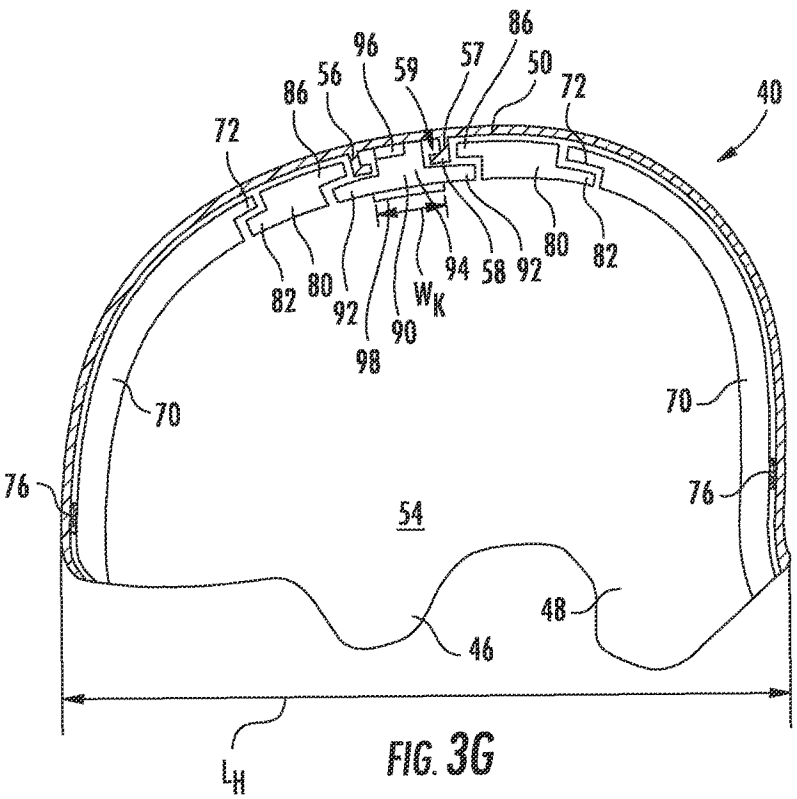

FIG. 3G shows a cross-sectional view of the helmet 40 in the state in which the helmet 40 was previously shown in FIG. 3F. FIG. 3G provides additional detail of how the lips 72, 82, 86, and 92 can interact to hold one or more, including all, of the side pieces 70, the top piece 80, and the locking piece 90 of the locking liner 60 together within the outer shell 50. FIG. 3G also provides additional detail of a non-liming embodiment of the locking piece 90 in which the locking piece 90 can comprise a tang 94 and a flange 96. The tang 94 can be disposed between multiple portions or pieces of the locking mechanism 56, as shown. The tang can also comprise one or more flanges 96 that can also be disposed between the portions or pieces of the locking mechanism 56. FIG. 3G shows the locking piece 90 in an insertion position, or a position in which the locking piece 90 would be after having been placed within the opening 84. Particular orientations or positions of the locking piece 90 can be required for insertion to prevent the locking piece 90 from being completely disposed within the opening 84 and extending into the interior surface 54 of the outer shell 50 or to a point at which the locking piece can be releasably coupled to the locking mechanism 56. The locking piece 90 can, for example, be prevented from being completely disposed within the opening 84 by interference between the flanges 96 and portions of the locking mechanisms 56, such as the horizontal portions 58. After initial insertion, the locking piece 90 can be moved or adjusted, such as by rotation, to allow for the locking piece 90 to be locked into the locking mechanism 56, such as be disposing the flanges 96 within the void, gap, or interface 59.

FIG. 3H shows a perspective view, similar to the perspective view shown in FIG. 3F. FIG. 3H differs from FIG. 3F in that the locking piece 90 has been moved, adjusted, or rotated such that the knob 98 has been rotated or moved from its insertion position to be coupled to, or fully engaged with the locking mechanism 56. The knob 98 and locking piece 90 can be rotated 90 degrees from the position of the knob 98 shown in FIG. 3F so that the length Lk of the knob 98 can be parallel with or aligned with the length of the helmet Lh. By rotating or moving the locking piece 90 of the locking liner 60, the locking piece 90 of the locking liner 60 and an entirety of the locking liner 60 can be removably coupled to the outer shell 50 as part of glueless assembly between the locking liner 40 and the outer shell 50 of the helmet 40. In other embodiments, a hardened in-mold plastic locking piece 90 may be added to the locking piece 90 of the locking liner 60 in embodiments where a more secure attachment is needed between the locking piece 90 and the helmet.

Figure 3J:
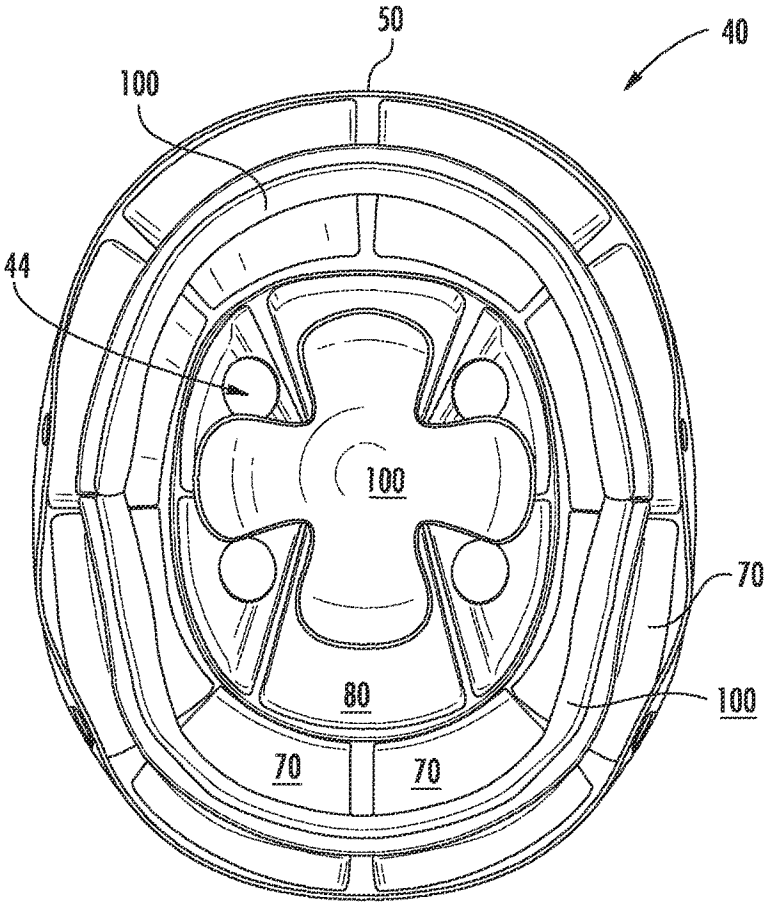
Figure 3I:
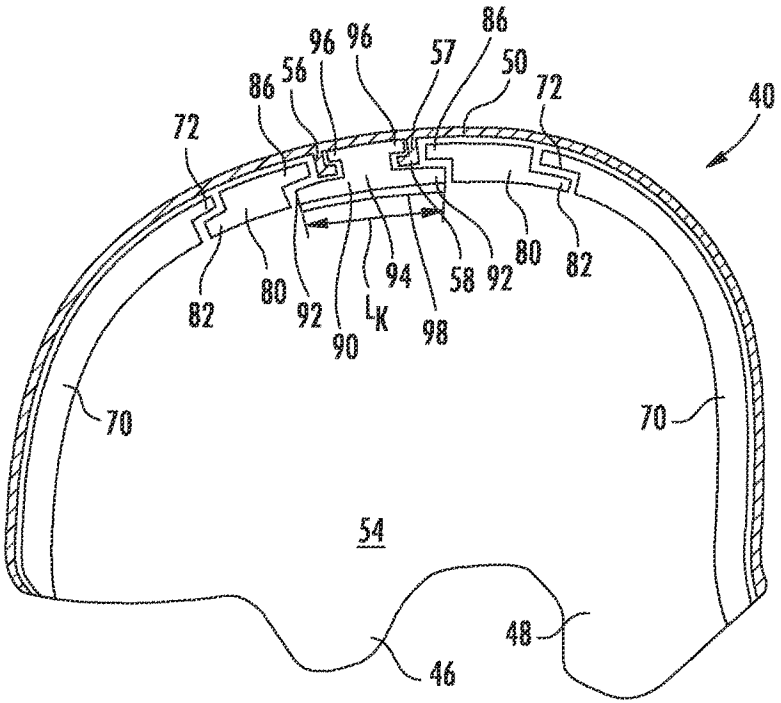

FIG. 3I shows a cross-sectional view of the helmet 40 similar to the cross-sectional view shown in FIG. 3G. FIG. 3I shows the cross-sectional view of the helmet 40 in the state or position in which the helmet 40 was previously shown in FIG. 3H, that is when the locking piece 90 is releasably coupled to the locking mechanism 56 so that the lips 72, 82, 86, and 92 can interact to hold one or more, including all, of the side pieces 70, the top piece 80, and the locking piece 90 of the locking liner 60 together within the outer shell 50. FIG. 3I also provides additional detail of a non-liming embodiment of the locking piece 90 in which the locking piece 90 comprises the tang 94 and the flange 96. FIG. 3I shows the tang 94 disposed between multiple portions or pieces of the locking mechanism 56, with one or more flanges 96 that are disposed between the portions or pieces of the locking mechanism 56. FIG. 3I shows the locking piece 90 in a locked position, or a position in which the locking piece 90 could be moved after having been initially inserted. As shown in FIG. 3I, the locking piece 90 can be positioned with the flanges 96 disposed within the void, gap, or interface 59, such as by rotation, to hold the locking liner within the outer shell 50 for safe and normal operation in which the locking liner 60 can provide energy management and protection to the user wearing the helmet 40.

FIG. 3J, proceeding from FIG. 3H or 3I, shows a non-limiting example of the helmet 40 comprising an optional comfort padding, comfort liner, or fit liner 100. The comfort padding 100 can be disposed within the space created for the user's head by the locking liner 60, and can also be disposed adjacent, and in contact with, an inner surface of the locking liner 60. The comfort liner 100 can be made of textiles, plastic, foam, polyester, nylon, or other suitable materials. The comfort liner 100 can be formed of one or more pads of material that can be joined together, or formed as discrete components, that can be coupled to the helmet 40. The comfort liner 100 can be releasably or permanently attached to the helmet 40, such as the locking liner 60, using an adhesive, permanent adhesive, PSA, foam-core adhesive, tape, two-sided tape, mounting foam adhesive, fastener, clip, cleat, cutout, tab, snap, rivet, hog ring, or hook and loop fasteners, or other interlocking surfaces, features, or portions. As such, the comfort liner 100 can provide a cushion and improved fit for the wearer of the helmet 40.

Advantageously, the helmet 40 comprising the locking liner 60 and the locking mechanism 56 can provide a glueless assembly that allows for improved ease of replacing the locking liner 60 of the helmet. Because helmet liners and energy management materials are often rated to protect a user for only a single impact before needing to be replaced, an outer shell that can withstand multiple impacts and that is permanently attached to the energy absorbing material or liner can be prematurely retired. By utilizing the system, method, and devices disclosed herein, the outer shell 50 can be used for more than one impact by replacing a used or damaged locking liner 60 with a new liner locking liner 60. By using a removable or replaceable locking liner 60 as part of the helmet 40, a technician or other individual can replace only the inner liner layers of energy absorbing material and reuse the outer shell portion, thereby reducing waste and increasing savings without compromising safety. A replaceable locking liner 60 can also allow for recycling of a helmet without the need to replace the expensive outer shell portion of the helmet.

Where the above examples, embodiments and implementations reference examples, it should be understood by those of ordinary skill in the art that other helmet and manufacturing devices and examples could be intermixed or substituted with those provided as virtually any components consistent with the intended operation of a method, system, or implementation may be utilized. Accordingly, for example, although particular component examples may be disclosed, such components may be comprised of any shape, size, style, type, model, version, class, grade, measurement, concentration, material, weight, quantity, and/or the like consistent with the intended purpose, method and/or system of implementation. In places where the description above refers to particular embodiments of on-piece no slip strap adjustors for helmets, it should be readily apparent that a number of modifications may be made without departing from the spirit thereof and that these embodiments and implementations may be applied to other to gear and equipment technologies as well. Accordingly, the disclosed subject matter is intended to embrace all such alterations, modifications, and variations that fall within the spirit and scope of the disclosure and the knowledge of one of ordinary skill in the art. The presently disclosed embodiments are, therefore, to be considered in all respects as illustrative and not restrictive.

What is claimed is:

1. A helmet comprising:

an outer shell comprising an outer surface and an inner surface opposite the outer surface, wherein the inner surface of the outer shell comprises an integrally formed locking mechanism that extends from a top of the inner surface of the outer shell, the integrally formed locking mechanism comprising a single continuous piece that is part of the outer shell, a vertical portion that extends away from the inner surface of the outer shell to a distal end, and a horizontal portion that extends from the vertical portion to form a gap; and a locking liner formed of a foam material and disposed within the outer shell adjacent the inner surface of the outer shell, the locking liner further comprising:

at least one side piece formed of the foam material and sized to fit between a lower edge of the outer shell and top portion of the outer shell, a top piece formed of the foam material and disposed at the top portion of the outer shell and comprising a central opening, and a rotatable foam locking piece sized to fit within the central opening and comprising a tab that is sized to mateably couple with the gap of the integrally formed locking mechanism such that when the foam locking piece is rotated in a first direction the foam locking piece releasably couples the locking liner to the outer shell and when the foam locking piece is rotated in a second direction opposite the first direction the foam locking piece uncouples the locking liner and the outer shell.

2. The helmet of claim 1, wherein the locking liner is releasably coupled to the outer shell with a mechanical connection of the rotatable foam locking piece and the integrally formed locking mechanism of the outer shell without hook and loop fasteners and without an adhesive.

3. The helmet of claim 2, wherein the rotatable foam locking piece comprises a circular footprint to allow the rotatable foam locking piece to rotatably engage with the integrally formed locking mechanism of the outer shell.

4. The helmet of claim 3, wherein the integrally formed locking mechanism comprises:

the horizontal portion extending from the distal end of the vertical portion to form the gap.

5. The helmet of claim 4, wherein the foam of the locking liner and the rotatable foam locking piece comprise expanded polypropylene (EPP), expanded polystyrene (EPS), expanded polyurethane (EPU), or expanded polyolefin (EPO).

6. The helmet of claim 5, wherein:

the at least one side piece comprises a first lip along an upper edge of the at least one side piece;

the top piece comprises a second lip disposed at a lower edge of the top piece, the second lip sized to mateably couple with the first lip and further comprises a third lip disposed around the central opening; and the rotatable foam locking piece comprises a fourth lip around an edge of the rotatable foam locking piece, the fourth lip sized to mateably couple with the third lip and releasably couple the top piece and the at least one side piece to the outer shell.

7. The helmet of claim 1, wherein an adhesive or hook and loop fasteners are disposed between a portion of the locking liner and the inner surface of the outer shell to releasably couple the locking liner to the outer shell together with the mechanical connection of the rotatable foam locking piece and the integrally formed locking mechanism of the outer shell.

8. A helmet comprising:

an outer shell comprising an outer surface and an inner surface opposite the outer surface, wherein the inner surface of the outer shell comprises a locking mechanism that extends from a top of the inner surface of the outer shell, the locking mechanism comprising a single continuous piece that is part of the outer shell, a vertical portion that extends away from the inner surface of the outer shell to a distal end, and a horizontal portion that extends from the vertical portion to form a gap; and a locking liner formed of a foam material and disposed within the outer shell, the locking liner further comprising:

a top piece formed of the foam material and comprising an opening, and a foam locking piece sized to fit within the opening and comprising a tab and sized to mateably couple with the gap of the locking mechanism of the outer shell to releasably couple the locking liner to the outer shell.

9. The helmet of claim 8, wherein the locking liner is releasably coupled to the outer shell with a mechanical connection of the foam locking piece and the locking mechanism of the outer shell without hook and loop fasteners and without an adhesive.

10. The helmet of claim 9, wherein the foam locking piece comprises a circular footprint to allow the foam locking piece to rotatably engage with the locking mechanism of the outer shell.

11. The helmet of claim 8, wherein the locking mechanism comprises:

the horizontal portion extending from the distal end of the vertical portion to form the gap.

12. The helmet of claim 8, wherein the foam of the locking liner and the foam locking piece comprise expanded polypropylene (EPP), expanded polystyrene (EPS), expanded polyurethane (EPU), or expanded polyolefin (EPO).

13. The helmet of claim 8, wherein an adhesive or hook and loop fasteners are disposed between a portion of the locking liner and the inner surface of the outer shell to releasably couple the locking liner to the outer shell together with a mechanical connection of the foam locking piece and the locking mechanism of the outer shell.

14. A helmet comprising:

an outer shell comprising an outer surface and an inner surface opposite the outer surface, wherein the inner surface of the outer shell comprises a locking mechanism that is part of the outer shell and extends from a top of the inner surface of the outer shell, a vertical portion that extends away from the inner surface of the outer shell to a distal end, and a horizontal portion that extends from the vertical portion to form a gap; and a locking liner formed of a foam material disposed within the outer shell, the locking liner comprising a foam locking piece comprising a tab that is sized to mateably couple with the gap of the locking mechanism of the outer shell to releasably couple the locking liner to the outer shell.

15. The helmet of claim 14, wherein the foam locking piece comprises a circular footprint to allow the foam locking piece to rotatably engage with the locking mechanism of the outer shell.

16. The helmet of claim 15, wherein the locking mechanism comprises:

the horizontal portion extending from the distal end of the vertical portion to form the gap.

17. The helmet of claim 16, wherein the locking liner comprises expanded polypropylene (EPP), expanded polystyrene (EPS), expanded polyurethane (EPU), or expanded polyolefin (EPO).

18. The helmet of claim 17, wherein an adhesive or hook and loop fasteners are disposed between a portion of the locking liner and the inner surface of the outer shell to releasably couple the locking liner to the outer shell together with the mechanical connection of the foam locking piece and the locking mechanism of the outer shell.

* * * * *